US007290600B2

(12) United States Patent
Gavula

(10) Patent No.: US 7,290,600 B2
(45) Date of Patent: Nov. 6, 2007

(54) AIR-TO-AIR HEAT PUMP DEFROST BYPASS LOOP

(75) Inventor: Patrick Gordon Gavula, Oklahoma City, OK (US)

(73) Assignee: York International Corporation, York, PA (US)

( * ) Notice: Subject to any disclaimer, the term of this patent is extended or adjusted under 35 U.S.C. 154(b) by 199 days.

(21) Appl. No.: 11/248,536

(22) Filed: Oct. 12, 2005

(65) Prior Publication Data

US 2006/0086496 A1 Apr. 27, 2006

Related U.S. Application Data

(62) Division of application No. 10/180,142, filed on Jun. 26, 2002, now Pat. No. 7,004,246.

(51) Int. Cl.
*F25B 29/00* (2006.01)

(52) U.S. Cl. ..... 165/231; 165/62; 165/267; 165/288; 165/291; 165/299; 62/160

(58) Field of Classification Search ..... 165/47, 165/61, 62, 267, 288, 291, 299, 231; 62/160
See application file for complete search history.

(56) References Cited

U.S. PATENT DOCUMENTS 4,158,950 A 6/1979 McCarty
4,178,767 A 12/1979 Shaw
4,338,790 A 7/1982 Saunders et al.
4,353,409 A 10/1982 Saunders et al.
4,389,851 A 6/1983 Chrostowski et al.
4,406,133 A 9/1983 Saunders et al.
4,407,137 A 10/1983 Hayes, Jr.
4,441,335 A 4/1984 Bonne
4,519,214 A 5/1985 Sano et al.
4,553,401 A 11/1985 Fisher
4,554,968 A 11/1985 Hass
4,573,326 A 3/1986 Sulfstede et al.
4,628,706 A 12/1986 Neudorfer
4,760,709 A 8/1988 Aoki et al.
4,770,000 A 9/1988 Kuroda et al.
4,796,437 A 1/1989 James
4,802,339 A 2/1989 Gregory
4,835,715 A 5/1989 Bench et al.
4,843,838 A 7/1989 Trask
4,852,360 A 8/1989 Harshbarger et al.
4,882,908 A 11/1989 White (Continued)

*Primary Examiner*—Ljiljana Ciric
(74) *Attorney, Agent, or Firm*—McNees Wallace & Nurick LLC

(57) ABSTRACT

A system for defrosting an air-to-air heat pump system is disclosed. A bypass loop transfers refrigerant at a higher temperature and pressure than is normally cycled through the outdoor unit to an outdoor coil to defrost ice on the outdoor coil. The bypass loop includes a valve movable between closed and open positions. A sensor monitors a preselected condition indicative of outdoor coil performance. A controller communicates with the valve and the sensor. Once the controller determines that a preselected set point of a preselected condition indicative of deteriorating performance has been reached, the controller sends a signal to open the valve, allowing warm refrigerant to bypass expansion valves and flow to the outdoor unit to defrost the outdoor unit. Once defrosting is accomplished, the valve can be moved to a closed position to resume normal operation of the heat pump unit.

23 Claims, 7 Drawing Sheets

U.S. PATENT DOCUMENTS 4,912,937 A 4/1990 Nakamura et al.
5,025,640 A 6/1991 Drucker
5,105,629 A 4/1992 Parris et al.
5,186,021 A 2/1993 Keller
5,257,506 A 11/1993 DeWolf et al.
5,269,151 A 12/1993 Dinh
5,275,008 A 1/1994 Songe et al.
5,309,733 A 5/1994 Hayashida et al.
5,729,985 A 3/1998 Yoshihara et al.
5,758,507 A 6/1998 Schuster et al.
5,839,292 A 11/1998 Hwang
5,983,660 A 11/1999 Kiessel et al.
6,012,294 A 1/2000 Utsumi
6,615,602 B2 9/2003 Wilkinson

AIR-TO-AIR HEAT PUMP DEFROST BYPASS LOOP

CROSS REFERENCE TO RELATED APPLICATIONS

This application is a divisional of prior application Ser. No. 10/180,142, filed Jun. 26, 2002 now U.S. Pat. No. 7,004,246.

FIELD OF THE INVENTION

The present invention is directed to a defrost mechanism for air-to-air heat pump systems operating in the heating mode for defrosting the outdoor coil of the outdoor unit based on predetermined conditions of the outdoor coil, thereby reducing the need for de-icing electric heating elements or decreasing the amount of time required for defrosting the outdoor coil, or both.

BACKGROUND OF THE INVENTION

Air-to-air heat pump systems are heat moving devices used in residential and commercial applications. Heat is absorbed in an evaporator in a first location and released in a condenser in a second location. The systems are designed so that operations can be reversed so that an area can be either cooled or heated. Thus, on reversal of the heat flow direction, the evaporator at the first location becomes a condenser; and the condenser at the second location becomes an evaporator.

During the heating cycle, the outdoor unit acts as an evaporator and the indoor unit acts as a condenser. Moisture from the outdoor air will condense on the outdoor coil. As the ambient temperature decreases below about 45° F., the outdoor coil temperature will rapidly approach 32° F. or lower, causing the condensed moisture to turn to ice. The ice restricts the airflow across the coil, which in turn affects the ability of the evaporator to efficiently perform its function of absorbing heat from the ambient air as the refrigerant fluid undergoes a phase change when at least a portion of the refrigerant fluid is converted from a liquid state into a gaseous state. The formation of the ice thus reduces the performance or efficiency of the heat pump system. In order to restore performance, the system will enter an evaporator defrosting cycle. The defrosting cycle on some heat pumps begins with a timed period of supplemental electric heat applied to the frosted or iced coil by de-icing electric heating elements. Also in common use today are defrost controls. These are based upon temperature differentials, pressure differentials or a combined time/temperature differential. These units reverse the operation of the heat pump so that the flow of hot refrigerant is reversed, flowing in the opposite direction than required for heating, that is, flowing directly from the compressor to the outdoor unit in order to heat the outdoor unit. There are many variations of how this is accomplished. One such device is described in Trask, U.S. Pat. No. 4,843,838 issued Jul. 4, 1989. However, while the unit is in such a defrost cycle, it is not providing heat as the refrigerant flow is in the direction for cooling. If there is still a heat demand required in the space being heated, the heat demand typically is satisfied with supplemental electric resistance heat, which is expensive in comparison to the cost of running a heat pump.

Different bypass methods and apparatus for defrosting or de-icing have been taught. McCarty, U.S. Pat. No. 4,158,950 issued Jun. 26, 1979, discloses a bypass arrangement in which defrosting is accomplished by refrigerant after the compressor has stopped operation and any pressure differential within the system is equalized. Thus, operation of the heat pump system cannot be accomplished during the de-ice cycle and auxiliary heat solely must be relied upon to heat any designated areas during the de-icing operation.

In Chrostowski et al., U.S. Pat. No. 4,389,851 issued Jun. 28, 1983, a combination of reverse and nonreverse defrost is utilized to de-ice the heat exchanger. During de-icing, a three way valve directs gas from the compressor to an outdoor coil. The only heat exchange path during the defrost mode is from the compressor to the outdoor unit. A valve closes to prevent the flow of refrigerant between the indoor unit and the outdoor unit. This valve and a reversing valve isolate the indoor unit from the outdoor unit as refrigerant from the compressor defrosts the outdoor coil.

Bonne, U.S. Pat. No. 4,441,335, issued Apr. 10, 1984, is similar to Chrostowski et al. in that the bypass arrangement moves discharge refrigerant from the compressor directly to the outdoor coil. In addition to utilizing a plurality of three way valves to direct the flow of the refrigerant, Bonne provides no circuit between the indoor unit and the outdoor unit in which the refrigerant is not first required to pass through an expansion valve, thereby lowering its pressure.

Sato et al., U.S. Pat. No. 4,519,214 issued May 28, 1985, utilizes a branch circuit for the defrost cycle that passes hot compressor refrigerant through the outdoor unit to de-ice the outdoor coil. However, to accomplish this task, the cycle is first reversed, thereby causing the air-to air heat pump to be placed into the cooling mode and converting the outdoor unit into a condenser. The refrigerant fluid passes through the outdoor coil/condenser and back to the compressor until defrost is accomplished.

Aoki et al, U.S. Pat. No. 4,760,709 issued Aug. 2, 1988, utilizes a five-way valve to direct a portion of hot refrigerant gas from the compressor to the outdoor unit to accomplish defrost of the outdoor unit, while continuing a flow of the remaining refrigerant from the compressor to the indoor unit so that the heat pump can continue to provide heat during the defrost cycle. After the refrigerant leaves the indoor unit, it passes to the outdoor unit/evaporator through an expansion valve in the usual manner. There is no other connection or branch between the indoor and outdoor unit.

An arrangement of utilizing refrigerant leaving the indoor unit and indoor coil for a defrost/de-ice cycle would be effective in making use of relatively high pressure refrigerant having a temperature significantly higher than that of the outdoor ambient temperature or the outdoor coil. Such an arrangement would not seriously impact the heating functions of the air-to-air heat pump and would eliminate the need to reverse the operation of the heat pump. It would also eliminate or reduce the need to rely on supplemental auxiliary heat during the defrost cycle. A simple arrangement that utilizes minimal and readily available equipment is desirable to keep manufacturing costs low. Furthermore, a unit having predetermined set points that can be changed simply by a user is also desirable to increase the flexibility of the system as a result of the environment in which it is installed.

SUMMARY OF THE INVENTION

The present invention is directed to an improvement in defrosting an air-to-air heat pump system when in the heating mode. The present invention utilizes a bypass loop that takes refrigerant that is at a higher temperature and pressure than refrigerant normally cycled through the outdoor unit and transfers the refrigerant to the outdoor coil. This higher temperature refrigerant can then defrost any ice that has been formed on the outdoor coil by heating the outdoor coil. The bypass loop includes a valve that is capable of being controlled remotely, the valve being movable from a closed position to an open position. A sensor is positioned to monitor a preselected condition indicative of performance of the outdoor unit. The performance of the outdoor unit is an effective way of determining whether icing or frosting is inhibiting its operation. A controller is in communication with both the valve and the sensor. Once the controller determines that a preselected set point of a first preselected condition has been reached and while the compressor is still operating, based on signals received from the sensor, the controller sends a signal to open the valve to allow warm refrigerant to bypass expansion valves and flow directly to the outdoor unit, where it can defrost or assist in defrosting the outdoor unit. Once the controller determines that defrosting has been accomplished, again based on a second predetermined condition having been achieved as determined by the controller, the valve can be moved into a closed position and the normal operation of the air-to-air heat pump unit can be resumed.

An advantage of the present invention is that the de-icing electric heating elements and the cost associated with its operation may be eliminated.

A further advantage of the present invention is that the heat pump system can remain in the heating mode during the defrost/de-ice operation, so that the indoor unit continues to operate as a condenser and the outdoor unit continues to operate as an evaporator. It is not necessary to reverse the cycle of the heat pump to place it into the cooling mode to accomplish defrost/de-ice.

Another advantage of the present invention is that, when used in conjunction with conventional defrosting methods, the defrost cycle can be significantly shortened, thereby reducing the cost of operation of the defrost cycle. An associated advantage is that heat pump heating operations will be restored more rapidly, thereby reducing the amount of time that the heat pump system must utilize supplemental electric heat, further reducing costs and increasing the Heating Seasonal Performance Factor (HSPF) of the heat pump system.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
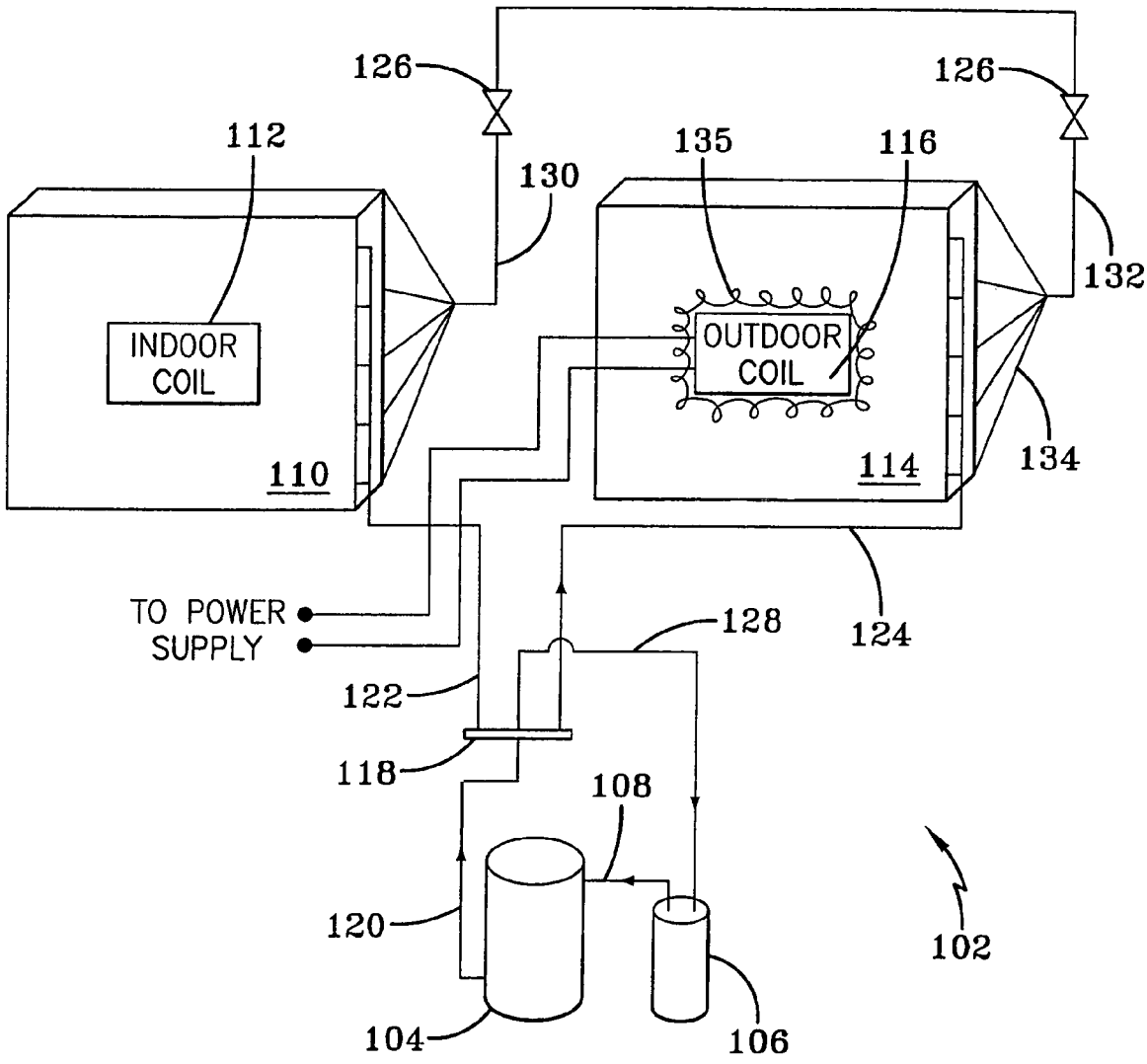
FIG-1 PRIOR ART
FIG. 1 is a schematic of a prior art air-to-air heat pump system.

A typical prior art air-to air heat pump system 102 is shown in FIG. 1. A compressor 104 compresses refrigerant fluid and transmits the refrigerant as high pressure vapor via line 120 to a reversing valve 118. The reversing valve 118 allows the heat pump system 102 to switch between heating and cooling mode by reversing the flow of the refrigerant through the system. For the purposes of this invention, heat pump system 102 is in the heating mode. However, the defrost scheme of the present invention is effective whether the heat pump system is in a heating or cooling mode. When in the heating mode, refrigerant flows along line 122 through indoor coil 112 of indoor unit or condenser 110 where it loses heat as it changes phase to high pressure liquid. The heat is distributed through the area to be heated by an air distribution system. The high pressure liquid flows from the condenser 110 through line 130 and into at least one expansion means 126 where it undergoes a pressure loss. FIG. 1 shows a second expansion means 126 which is utilized by the system 102 during the cooling cycle. For simplicity, these are shown in the same line, but they may be in separate lines. Alternatively, one of the expansion means 126 may be disconnected from the loop during the cycle that it is not required. The expansion means 126 is typically a device such as a valve that is located between indoor unit 110 and the outdoor unit 114. For heating cycles, high pressure liquid refrigerant leaving condenser 110 passes through the expansion device where it is converted into a low pressure liquid at a lower temperature. The low pressure liquid is transported along line 132 to manifold 134 the evaporator 114, passing through the outdoor coil 116 (which may be a plurality of finned tubes as is known in the industry) where at least a portion of the low pressure liquid undergoes a phase change from the low pressure liquid state to a gaseous state. The low pressure gas is transported along line 124 through reversing valve 118 to accumulator 106 where liquid refrigerant accumulates while gaseous refrigerant passes along line 108 to the compressor. The normal heating function of the heat pump typically cease during the de-icing cycle, and auxiliary heat is provided to the areas requiring heat while the de-icing is completed.

Figure 2:
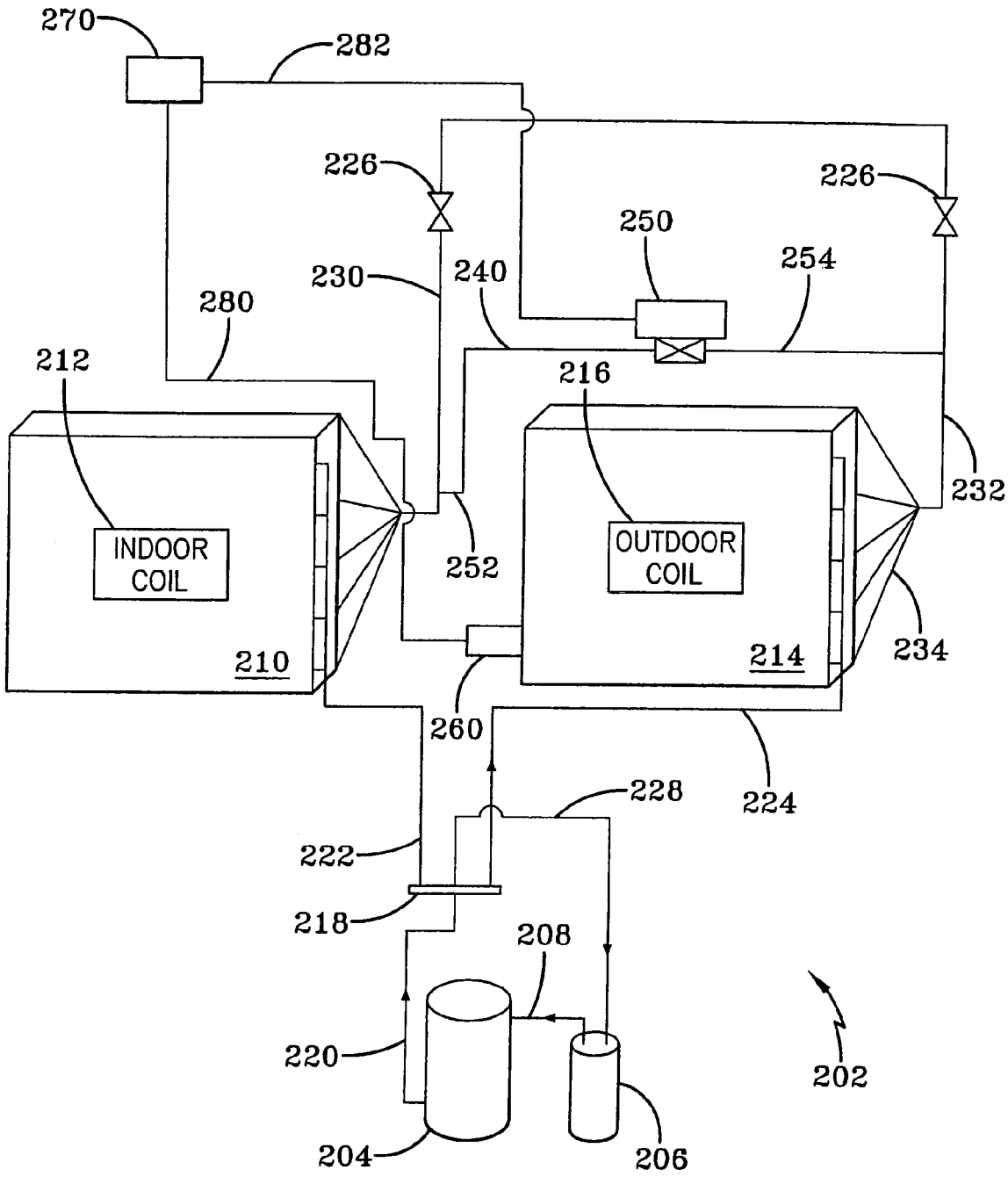
FIG. 2 is a schematic of a general embodiment of the air-to-air heat pump system of the present invention having a defrost bypass loop with a sensor associated with the outdoor unit.

When ice forms on the coils of the outdoor unit as humidity condenses on them at low temperatures, typically below about 45° F., the ability of the outdoor unit to properly operate by allowing evaporation of the low pressure liquid is inhibited. The present invention is an alternative method for defrosting the evaporator. The present invention defrosts the coils on the outdoor unit either without using conventional defrost methods thereby reducing the cost associated with such methods, or by working in conjunction with such elements thereby reducing the time and the expense associated with defrosting. Instead, the present invention utilizes a bypass defrost loop 240 as shown in FIG. 2. This loop 240 is connected to the refrigerant line, shown in FIG. 2 at 230, to draw high pressure refrigerant to the outdoor coil before it reaches expansion device 226. The loop 240 is controlled by a valve 250 which in turn is connected to a controller 270 that controls the operation of valve 250. Controller 270 in turn is connected to a sensor 260 that is located to sense a preselected condition of outdoor coil 216 or refrigerant in outdoor coil 216 or as it leaves outdoor coil 216 in supply line 224. Sensor 260 includes a means for providing at least one signal indicative of the sensed preselected condition of outdoor coil 216 or refrigerant in outdoor coil 216 or as it leaves outdoor coil 216 in supply line 224.

Sensor 260 can be located in a variety of positions to sense any one of several conditions in outdoor unit 214 that are associated with its performance. Sensor 260 can be, for example, a temperature sensor or a pressure sensor. If it is a temperature sensor, it can readily be located on outdoor coil 216 to determine for example, when a temperature of about 32° F. is reached. If this temperature is reached, it is indicative of the formation of ice on outdoor coil 216. The temperature sensor can also be located within the outdoor unit 214, but not specifically on the coil, to sense, for example, the ambient temperature within the environment of outdoor unit 214. The temperature sensor can also be located outside outdoor unit 214 to measure the ambient atmospheric air temperature. The sensor can also be located in return line 224 between outdoor coil 216 and compressor 204 or associated refrigerant fluid supply means, such as accumulator 206, to monitor a preselected condition of the refrigerant fluid indicative of performance leaving outdoor unit 214. If sensor 260 is a pressure sensor, it can be located in return line 224 between outdoor coil 216 and compressor 204 or associated accumulator 206 to monitor the gas pressure of the refrigerant leaving outdoor coil 216.

The controller 270 controls the operation of bypass defrost loop 240 by controlling operation of valve 250 in the bypass defrost loop 240. When the heat pump system 202 is operating normally, supplying heat to the areas to be heated, valve 250 is in the closed position, causing refrigerant to flow through the expansion device 226 to be converted from a high pressure liquid to a low pressure liquid, and then be moved to outdoor unit 214 which is acting as an evaporator. However, controller 270, which includes a means for both receiving and monitoring signals from the sensor 260 indicative of a condition that is associated with the performance of outdoor coil 214, further has a means for providing at least one signal that will open valve 250 once a signal from sensor 260 indicates that a first predetermined set point has been reached. This set point can be preprogrammed into controller 270, but may be changed by a user if desired. There are several different ways that controller 270 can operate to defrost outdoor coil 216. If desired, all of these modes can be preprogrammed into controller 270 and can be selected by the user, as will be discussed. The controller 270, however, must be capable of performing at least one of these modes.

Regardless of which mode is chosen, the basic operation of the loop is the same. Once valve 250 is opened, a portion of high temperature, high pressure liquid refrigerant flows through defrost bypass loop 240, bypassing the expansion device 226, and then through the coils 216 of outdoor unit 214. The liquid refrigerant passing through the defrost bypass loop 240, being of higher temperature, depending upon the configuration, from 70° F. as high as 185° F., but typically about 70° to about 90° F., than the temperature of the liquid refrigerant passing through the expansion device, typically from about 48°-56° F. transfers its heat to coil 216 causing defrosting and melting of any ice formed on the coil 216. The cooled refrigerant fluid is then returned to the accumulator 206 or the compressor 204. Valve 250 can remain open until a second predetermined condition is obtained. For example, this predetermined condition can be a preselected passage of time. Alternatively, it can be a signal from the sensor to the controller indicating that a second predetermined set point has been reached.

EXAMPLE 1

Figure 3:
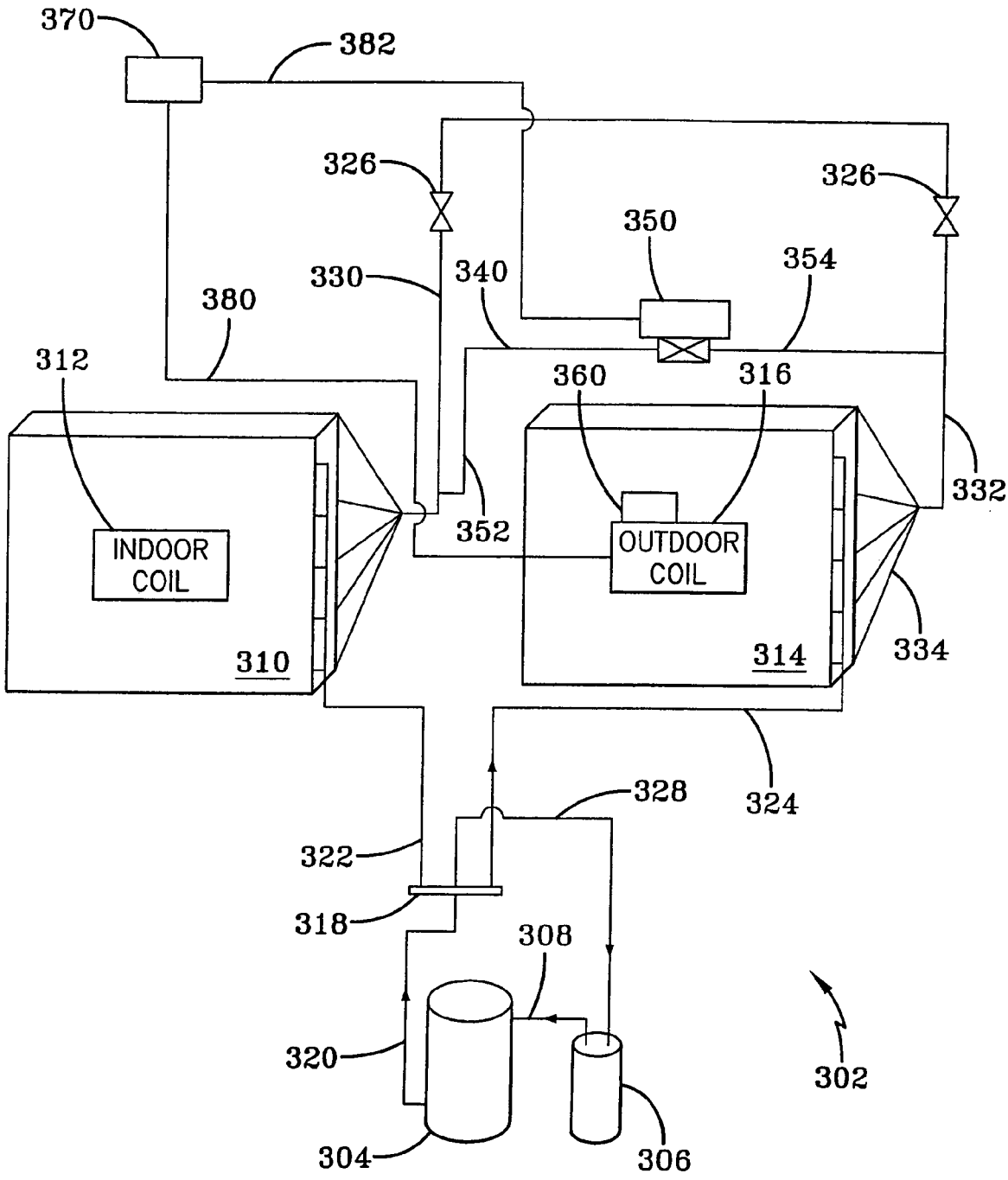
FIG. 3 is a schematic of a first embodiment of the heat pump system of the present invention with a temperature sensor attached to the outdoor coil.

An air-to-air heat pump system 302, shown in the heating mode, includes a defrost bypass loop 340 as depicted in FIG. 3. A defrost bypass loop 340 connects a refrigerant discharge means, such as a discharge line 330, from the indoor coil unit 310 to the inlet line 332 of the outdoor unit. A bypass line having a first end 352 and a second end 354 connects to discharge line 330 at its first end 352 between indoor coil unit 310 and expansion device 326. A valve 350 is located in bypass line. Bypass line 352, 354 connects to inlet line 332 at its second end 354.

A temperature sensing device 360 is placed in contact with outdoor coil 316 to periodically or continuously monitor the actual temperature of outdoor coil 316. Temperature sensing device 360 can be any well known temperature monitoring device such as a thermocouple, thermistor and the like. Temperature sensing device 360 is in communication with controller 370 along path 380. Communications path 380 may be any convenient method of transferring a signal from temperature sensing device 360 to controller 370. Thus, temperature sensing device 360 may be hardwired to controller 370, so that path 380 is the hard wiring that permits the signal from device 360 indicative of the temperature of outdoor coil 316 to be sent to controller 370. Alternatively, temperature sensing device 360 may include circuitry that permits a signal indicative of temperature of the outdoor coil 316 to be transferred via RF waves, infrared waves or other suitable electromagnetic transmission to controller 370, which controller includes means to receive such electromagnetic transmission.

Controller 370 is in communication with valve 350 along a communication path 382. As discussed above for the communication path between the temperature sensing device 360 and controller 370, the communications path 382 between controller 370 and valve 350 may be via hard wiring or electromagnetic wave, it being understood that when communications path 382 is electromagnetic wave communications, controller 370 includes the means to transmit an electromagnetic signal and valve 350 includes the means to receive the electromagnetic signal.

In operation, valve 350 is normally in the closed position when the heat pump system is running in the normal mode of heating an area. In this mode, all of the liquid refrigerant leaving indoor coil unit 310 passes through refrigerant line 330 into expansion device 326 and then into outdoor unit 314 through manifold 334. Temperature measuring device 360 attached to outdoor coil transmits a signal indicative of the temperature to controller 370 along path 380. The controller 370 is programmed for a first predetermined temperature set point indicating that the temperature of the outdoor coil is sufficiently low that a defrosting cycle must be performed. When temperature measuring device 360, transmits a signal to controller 370 indicating the that temperature of the outdoor unit corresponds to a first predetermined set point, controller 370 causes heat pump unit 302 to reduce or shut off its heating functions and transmits a signal along path 382 activating valve 350 to an open configuration. This permits a portion of the refrigerant at elevated temperatures in line 330 to be diverted through valve 350 into the second end 354 of the line between the indoor coil unit 310 and outdoor unit 314. This refrigerant then can flow into outdoor coil 316 through manifold 334. This warm refrigerant will heat outdoor coil 316 causing it to defrost. The defrosting process will continue until controller 370 receives a signal from temperature sensing device 360 that a second predetermined temperature set point higher than the first predetermined temperature set point has been reached. The controller then transmits a signal to valve 350 causing valve 350 to close. Controller 370 simultaneously signals heat pump system 302 to resume normal heating operations, shutting down any auxiliary heat that may have been activated. It should be noted that although this embodiment shows the defrost bypass loop as the only means of defrosting the outdoor coil, it will be understood by those skilled in the art that this defrost loop can be combined with conventional defrosting elements, such as for example electric heating elements, to accomplish a more rapid defrost cycle, if desired.

EXAMPLE 2

Figure 4:
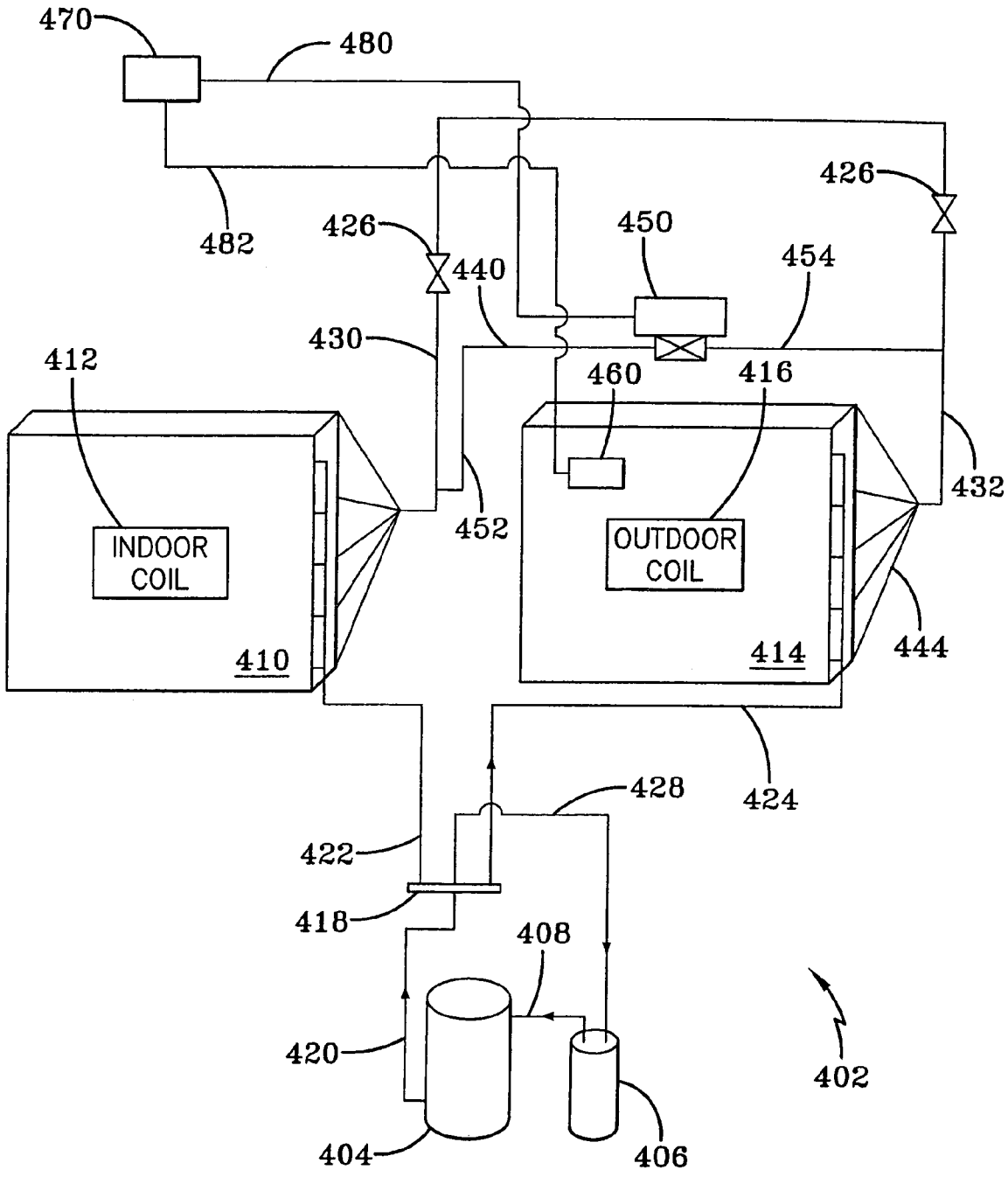
FIG. 4 is a schematic of a second embodiment of the heat pump system of the present invention with a temperature sensor monitoring ambient temperature within the outdoor coil.

Referring now to FIG. 4, a slight variation to the previously described defrost bypass loop 340 is set forth. This variation results in a different operation of the defrost bypass loop 440. Air-to-air heat pump system 402 is similar to heat pump system shown in FIG. 2. However, in this configuration, temperature sensor 460 is located within outdoor unit 414 to monitor the ambient temperature within outdoor unit 414, but not attached to outdoor coil 416. Alternatively, temperature sensor 460 may be located external to outdoor unit 414 to monitor the ambient temperature. When temperature measuring device 460, transmits a signal to controller 470 indicating that the temperature within outdoor unit 414, or alternatively the outdoor ambient temperature, corresponds to a predetermined set point, controller 470 activates a timing means, such as a timer, for use in a timed sequence operation, which may be preprogrammed into a programmable controller, causing heat pump unit 402 to reduce or shut off its heating functions and transmitting a signal along path 480 activating valve 450, such as a solenoid valve to an open configuration for a preselected time period. Refrigerant at elevated temperatures in line 430 is diverted through valve 450 into the second end 454 of the line between the indoor coil unit 410 and outdoor unit 414. This refrigerant flows into outdoor coil 416 through manifold 444 for a preselected time. This warm refrigerant will heat outdoor coil 416 causing it to defrost. After the preselected time has expired, the valve 450 closes and the heat pump resumes normal operation. The preselected time can be a fixed time or could vary depending upon the temperature sensed by sensing device 460, with longer defrosting times required for lower sensed temperatures. Normal operation resumes, but this defrosting process will cycle or repeat periodically at second preselected time intervals until controller 470 receives a signal from temperature sensing device 460 that a second predetermined temperature set point higher than the first predetermined temperature set point has been reached. The second preselected time interval may also be a fixed time interval or may vary depending upon the temperature sensed by the sensing device 460, with shorter intervals required for lower temperatures (i.e. the defrost cycles occur more often at lower temperatures) or as noted above, the defrost time interval can be longer at lower temperatures. Once the second predetermined temperature set point is reached, controller terminates the timed sequence operation by transmitting a signal to valve 450, causing valve 450 to close, if it is not already closed, which returns the heat pump to normal operation and resumes normal heating operations while, shutting down any auxiliary heat that may have been activated during the defrost cycle. It should be noted that although this embodiment shows the defrost bypass loop as the only means of defrosting the outdoor coil, it will be understood by those skilled in the art that this defrost loop can be combined with conventional defrosting heat elements to accomplish a more rapid defrost cycle, if desired.

EXAMPLE 3

Figure 5:
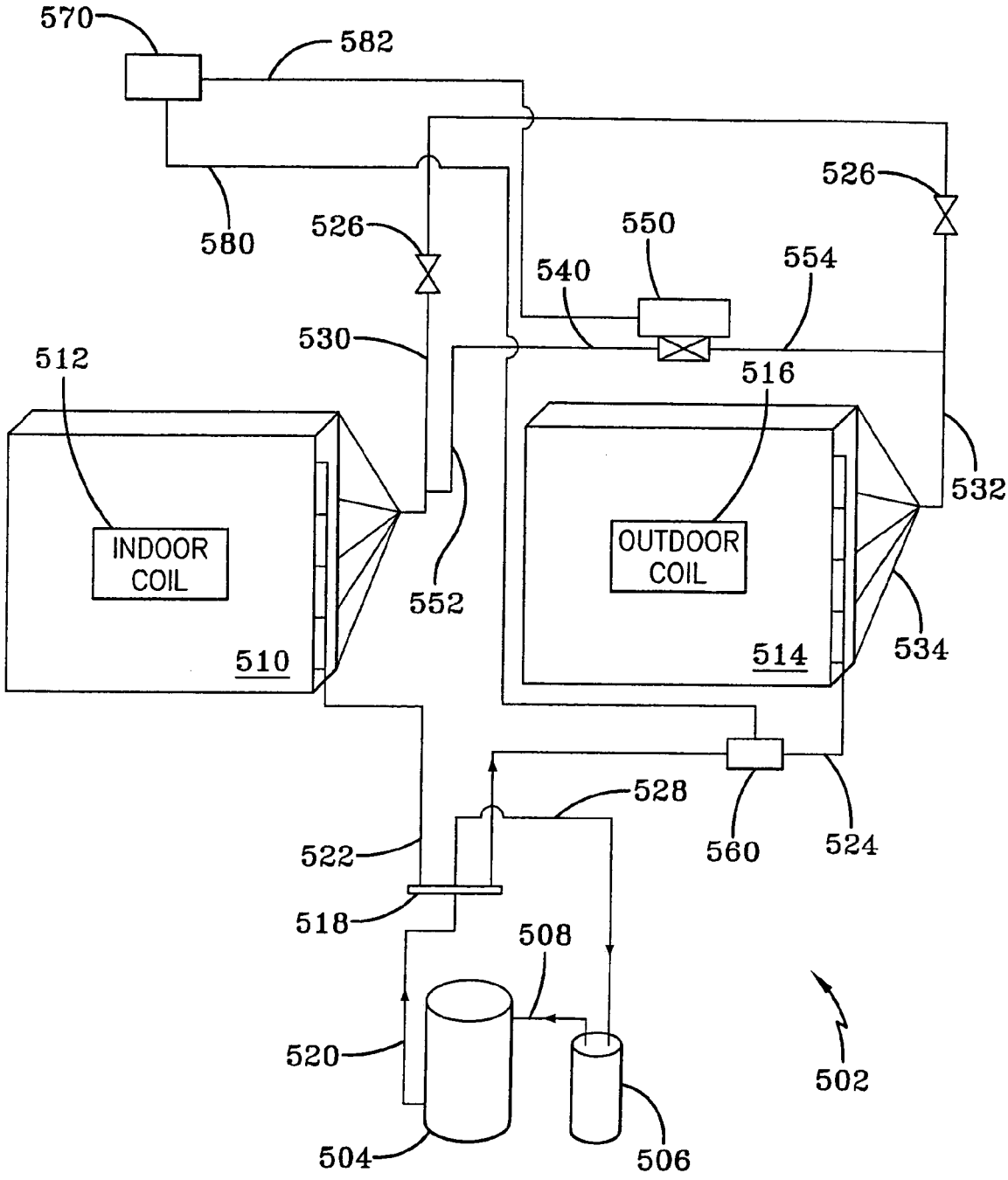
FIG. 5 is a schematic of a third embodiment of the heat pump system of the present invention with a sensor monitoring a preselected condition of the refrigerant fluid after the fluid has entered the evaporator unit.

Referring now to FIG. 5, a different embodiment of the present invention a slight variation to the previously described defrost bypass loops X40, where X40 represents any of the previously discussed loops, is set forth. This variation results in a different operation of the defrost bypass loop 540. Air-to-air heat pump system 502 is similar to heat pump system shown in FIG. 2. However, in this configuration, a sensor 560 is located either within outdoor coil 516 or within line 524 leaving the evaporator 514, as shown in FIG. 5, or within outdoor coil itself. Sensor 560 monitors a condition of the refrigerant. It can be set to monitor, for example the temperature of the refrigerant or the pressure of the refrigerant gas. For a refrigerant, the temperature at which a phase change from liquid to gas is known. If the temperature of the refrigerant is too low, insufficient refrigerant is undergoing a phase transformation from liquid to gas and the refrigerant gas pressure is also low. These conditions will occur when the proper functioning of the evaporator is hindered by icing conditions. Sensing device 560 senses a condition of the refrigerant, either pressure or temperature, and transmits a signal to controller 570 indicating the temperature of the refrigerant or the pressure of refrigerant gas either within return line 524, as shown, or within outdoor coil 516. If the sensed condition corresponds to a predetermined set point, controller 570 causes heat pump unit 502 to reduce or shut off its heating functions and transmits a signal along path 582 activating valve 550 to an open configuration. This permits a portion of the refrigerant at temperatures elevated temperatures in line 530 to be diverted through valve 550 into the second end 554 of the line between the indoor coil unit 510 and outdoor unit 514. This refrigerant then can flow into outdoor coil 516 through manifold 534. This warm refrigerant will heat outdoor coil 516 causing it to defrost. The defrosting process will continue until controller 570 receives a signal from sensing device 560 that a second predetermined condition set point higher than the first predetermined condition set point has been reached. The controller then transmits a signal to valve 550 causing the valve to close. Controller 570 simultaneously signals heat pump system 502 to resume normal heating operations, shutting down any auxiliary heat source that may have been activated. Alternatively, controller 570 can enter into a timed sequence operation, sending a signal to valve 550 after a first predetermined time to close it. In this configuration, the defrost cycle is a timed defrost cycle. It should be noted that although this embodiment shows the defrost bypass loop as the only means of defrosting the outdoor coil, it will be understood by those skilled in the art that this defrost loop can be combined with conventional defrosting elements such as electric elements, to accomplish a more rapid defrost cycle, if desired.

EXAMPLE 4

Figure 6:
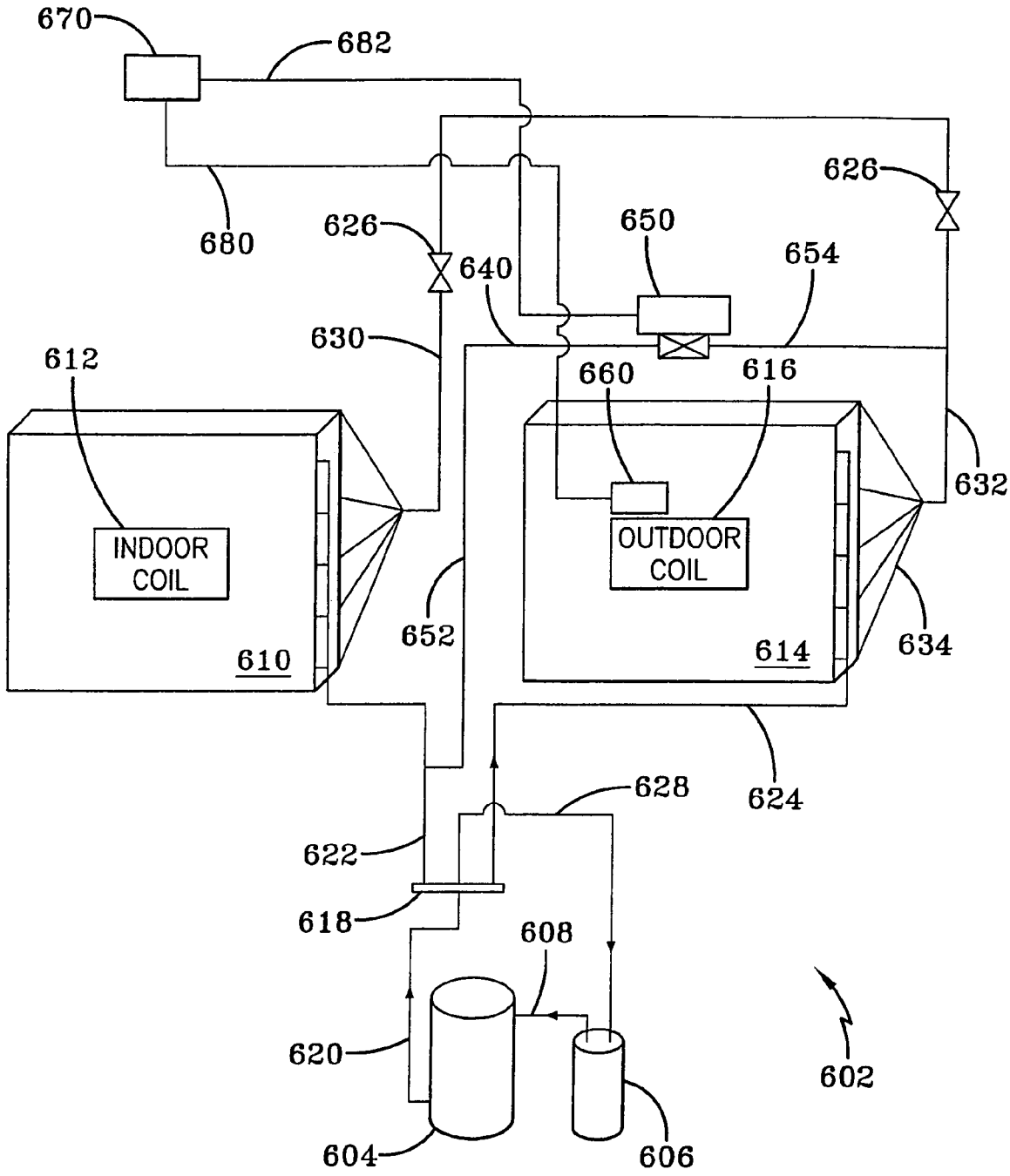
FIG. 6 is a schematic of a fourth embodiment of the heat pump system of the present invention with a defrost bypass loop that receives its refrigerant fluid from the compressor prior to the refrigerant passing into the condenser.

Referring now to FIG. 6, a different embodiment of the present invention is set forth. In this embodiment, air-to-air heat pump system 602 is similar to heat pump systems shown in FIG. 2 or in any of FIGS. 3, 4 or 5. However, in this configuration, a defrost bypass loop 640 is connected at its first end 652 to line 622 between the compressor 604 and condenser 610. While the defrost bypass loop can operate by any of the modes set forth in the previous examples, once valve 650 is opened by controller 670, a portion of refrigerant fluid discharged from the compressor 604, rather than from the condenser 610, flows through the bypass loop 640 where it moves through the second end 654 of the discharge line into line 632 and into manifold 634. Because this refrigerant fluid is significantly higher in temperature than refrigerant from condenser 610, the temperature ranging from about 160° F.-185° F. on discharge from compressor 604, the defrost cycle can be accomplished much more quickly. Since the flow of refrigerant to the condenser is reduced once valve 650 is open, it should be readily apparent to those familiar with the operation of such units that the ability of system 602 to provide heat will be reduced during the defrost cycle. It should be noted that although this embodiment shows the defrost bypass loop 640 as the only means of defrosting outdoor coil 616, it will be understood by those skilled in the art that this defrost loop can be combined with conventional defrosting heat elements to accomplish a more rapid defrost cycle, if desired.

EXAMPLE 5

Figure 7:
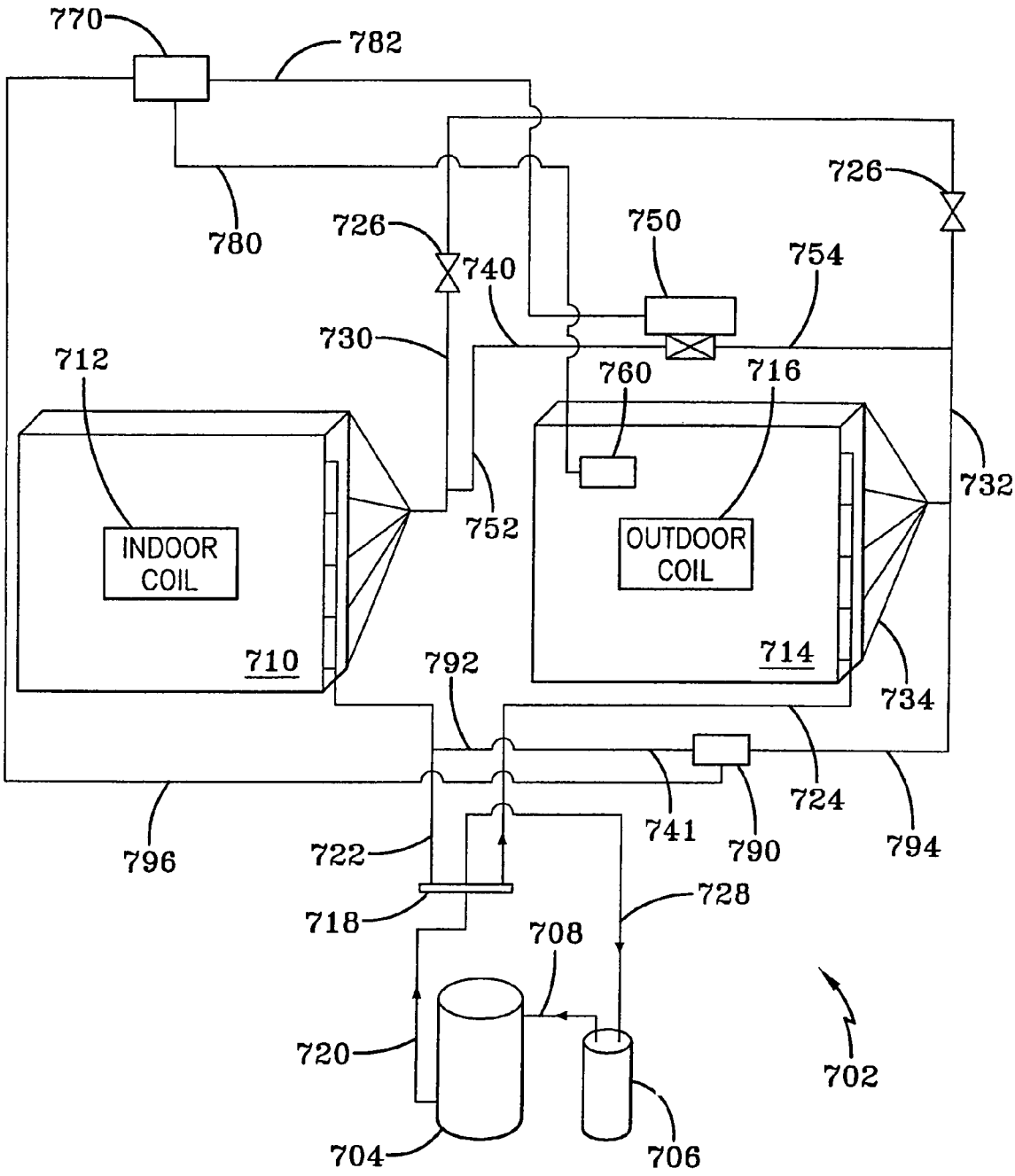
FIG. 7 is a schematic of a fifth embodiment of the heat pump system of the present invention having two defrost bypass loops, each loop receiving refrigerant fluid at different temperatures to increase the defrost capability of the system.

Referring now to FIG. 7, a more complex arrangement is set forth. This arrangement provides additional defrost capacity by combining the defrost bypass loops of FIG. 2 and FIG. 6. Sensors X60 where X60 represents any previously described sensor, may be placed in any of the positions previously discussed to sense preselected conditions. A first defrost bypass loop 740 with valve 750 is shown connected to line 730 from condenser 710. This defrost bypass loop operates in the same manner as the defrost bypass loops shown in FIGS. 3, 4 and 5 and discussed in greater detail above. Also included is a second defrost bypass loop 741. Loop 741 includes a second valve operable from a first position to a second position in response to a signal, such as previously discussed valves, a line having a first input end 792 connected to a line 722 from compressor 704, and a second discharge end 794 connected to a line 732, which is an inlet line to evaporator 714. Valve 790 is in communication with controller along path 796, in a manner similar to path 782, X82 where X82 represents previously described path as previously discussed. In operation, second valve 790 remains in a first closed position during normal operation of the heat pump. A signal from controller 770 is sent to second valve 790 to a second open position when controller determines that a third predetermined set point has been reached. This predetermined set point may be the same set point that opened valve 750. Alternatively, the controller may include an algorithm that includes a timing function. If, after a predetermined time, valve 750 is still open, controller may send a signal to valve 790 to open it, thereby adding additional defrost capacity to the system. Alternatively, controller 770 may be in communication with a second sensor (not shown) monitoring a second condition of the refrigerant or outdoor unit 714. If the second sensor provides a signal to controller 770 that a third predetermined set point is reached, or that the third predetermined set point is not reached within a second preselected time period, controller 770 sends a signal to open valve 790 to provide additional defrost capability to the system through second defrost bypass loop 741. Valve 790 may be closed either in response to a fourth predetermined set point being reached, as signaled by sensor 760, or after a preselected period of time. After defrost has been accomplishes as determined by controller 770, a signal can be transmitted to heat pump unit 702 to resume normal operation and to shut off auxiliary heat that may have been activated as a result of the defrost cycle. It should be noted that although this embodiment shows a pair of defrost bypass loops as the means of defrosting the outdoor coil, it will be understood by those skilled in the art that these defrost loops can be combined with conventional defrost elements, such as electric heating elements, to accomplish a more rapid defrost cycle, if needed.

The present invention sets forth a heat pump system that includes a defrost bypass loop that uses heat within the heat pump system to accomplish a defrost cycle. When used alone, it can eliminate the use of defrost elements, such as electric heating elements. When used in conjunction with conventional defrosting elements, it can reduce the amount of time that the defrosting elements are in use and can shorten the time required for a defrost cycle. The temperature range over which the heat pump system can operate efficiently may also be extended.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A heat pump being reversible between a heating cycle and a cooling cycle, comprising:

a compressor;

an indoor coil;

an outdoor coil;

an expansion means between the indoor coil and the outdoor coil, the expansion means being in fluid communication with the indoor coil and the outdoor coil to allow flow of the refrigerant fluid between the indoor coil and the outdoor coil;

a sensor for detecting a condition of the outdoor coil and providing a signal indicative of the condition of the outdoor coil;

a controller including a predetermined set point and means for receiving the signal indicative of the condition of the outdoor coil, the controller being configured to provide at least one signal when the predetermined set point has been achieved; and a refrigerant bypass circuit between the indoor coil and the outdoor coil, the refrigerant bypass circuit being in fluid communication with the indoor coil and outdoor coil to provide refrigerant from the indoor coil to the outdoor coil at an elevated temperature, the refrigerant bypassing the expansion means, the bypass circuit comprising a valve operable between a first closed position and a second open position in response to the at least one signal from the controller, a refrigerant fluid supply means, the supply means providing refrigerant fluid to the valve from between the compressor and the expansion device, a refrigerant fluid discharge means providing refrigerant discharge fluid passing through the valve to the outdoor coil, the refrigerant from the refrigerant bypass circuit at an elevated temperature defrosting the outdoor coil when the bypass circuit valve is open.

2. The heat pump of claim 1 wherein the sensor detects the temperature within the outside coil.

3. The heat pump of claim 1 wherein the sensor detects the temperature of the ambient air surrounding the outside coil.

4. The heat pump of claim 1 wherein the sensor detects the temperature of the refrigerant fluid at a point between the outdoor coil and the compressor.

5. The heat pump of claim 1 wherein the sensor detects a pressure of the refrigerant fluid between the outdoor coil and the compressor.

6. The heat pump of claim 5 wherein the sensor detects the pressure of the refrigerant fluid as it leaves the outdoor coil.

7. The heat pump of claim 1 wherein the predetermined set point of the controller corresponds to a first temperature, and the controller is configured to provide at least one signal in response to a determination that the first temperature has been achieved in the outdoor coil.

8. The heat pump of claim 7 wherein the at least one signal from the controller causes the valve in the bypass circuit to open, thereby permitting flow of hot refrigerant gas through the bypass circuit to the outdoor coil to defrost the coil.

9. The heat pump of claim 8 wherein the controller further includes a second predetermined set point and is configured to provide a second signal indicative of when the second predetermined set point has been achieved, the second signal causing the valve in the bypass circuit to close, thereby stopping flow of hot refrigerant gas through the bypass loop.

10. The heat pump of claim 9 wherein the second predetermined set point corresponds to a temperature higher than the first temperature.

11. The heat pump of claim 1 wherein the predetermined set point of the controller corresponds to a first pressure, and the controller is configured to provide a signal when the signal from outdoor unit sensor indicates that the first pressure has been achieved.

12. The heat pump of claim 11 wherein the controller, upon receiving the signal that the first pressure has been achieved, provides a first signal from the means for providing at least one signal to cause the valve in the bypass circuit to open, thereby permitting flow of hot refrigerant gas through the bypass circuit to the outdoor coil to defrost the coil.

13. The heat pump of claim 12 wherein the controller further includes a second predetermined set point and is configured to provide a second signal indicative of when the second predetermined set point has been achieved, the second signal causing the valve in the bypass circuit to close, thereby stopping flow of hot refrigerant gas through the bypass loop.

14. The heat pump of claim 13 further including an auxiliary heat source, the auxiliary heat source activated when the bypass circuit is open to defrost the outdoor coil.

15. The heat pump of claim 13 wherein the second predetermined set point corresponds to a pressure higher than the first pressure.

16. The heat pump of claim 1 wherein the refrigerant bypass circuit comprises a bypass line having a first end and a second end, the first end of the bypass line positioned on a discharge line from the compressor, the second end of the bypass line positioned between an inlet line to the outdoor coil and the expansion means, the valve positioned in the bypass line between the first end and the second end.

17. The heat pump of claim 1 further including an auxiliary heat source, the auxiliary heat source operable in response to a signal from the controller when the predetermined set point has been achieved.

18. A heat pump being reversible between a heating cycle and a cooling cycle, comprising:

a compressor;

an indoor coil;

an outdoor coil;

an expansion means between the indoor coil and the outdoor coil, the expansion means being in fluid communication with the indoor coil and the outdoor coil to allow flow of the refrigerant fluid between the indoor coil and the outdoor coil;

a sensor for detecting a condition of the outdoor coil and providing a signal indicative of the condition of the outdoor coil;

a programmable controller including predetermined set points, the controller including means for receiving the signal from the sensor indicative of the condition of the outdoor coil, the controller further being configured to provide signals when the predetermined set points are achieved;

means for defrosting the outdoor coil, wherein the means for defrosting the outdoor coil includes a refrigerant bypass circuit that provides hot refrigerant to the outdoor coil at an elevated temperature, the refrigerant bypassing the expansion means, the bypass circuit comprising a valve operable between a first closed position to a second open position in response to a first signal from the controller, and the second open position to the first closed position in response to a second signal from the controller, a refrigerant fluid supply means, the supply means providing hot refrigerant fluid to the valve, the supply means located upstream of the expansion means between the compressor and the expansion means, a refrigerant fluid discharge means providing refrigerant discharge fluid passing through the valve to the outdoor coil, the refrigerant bypass circuit defrosting the outdoor coil when the bypass circuit valve is open; and an auxiliary heat source, the auxiliary heat source being activated in response to a third signal from the controller and inactivated in response to a fourth signal from the controller.

19. The heat pump of claim 18 wherein the means for defrosting the outdoor coil further includes electric heating elements.

20. The heat pump of claim 18 wherein the auxiliary heat source is activated in response to the first signal from the controller and inactivated in response to the second signal from the controller.

21. The heat pump of claim 18 wherein the supply means providing hot refrigerant to the valve is the compressor.

22. A heat pump being reversible between a heating cycle and a cooling cycle, comprising:

a compressor;

an indoor coil;

an outdoor coil;

an expansion means between the indoor coil and the outdoor coil, the expansion means being in fluid communication with the indoor coil and the outdoor coil to allow flow of the refrigerant fluid between the indoor coil and the outdoor coil;

a sensor for detecting a condition of the outdoor coil and providing a signal indicative of the condition of the outdoor coil;

a programmable controller including predetermined set points, the controller including means for receiving the signal from the sensor indicative of the condition of the outdoor coil, the controller further including means for providing signals when the predetermined set points are achieved; and means for defrosting the outdoor coil, wherein the means for defrosting the outdoor coil includes a first refrigerant bypass circuit that provides hot refrigerant from the condenser to the outdoor coil at an elevated temperature, the first refrigerant bypass circuit bypassing the expansion means, the first refrigerant bypass circuit comprising a valve operable between a first closed position to a second open position in response to a first signal from the controller, and the second open position to the first closed position in response to a second signal from the controller, and a second refrigerant bypass circuit that provides hot refrigerant from the compressor to the outdoor coil at an elevated temperature, the second refrigerant bypass circuit bypassing the expansion means, the second refrigerant bypass circuit comprising a valve operable between a first closed position to a second open position in response to a third signal from the controller, and the second open position and the first closed position in response to a fourth signal from the controller.

23. The heat pump of claim 22 further including a second sensor for detecting a condition and for providing a signal indicative of the condition to the controller.

* * * * *